US006269877B1

(12) United States Patent
Zeer et al.

(10) Patent No.: US 6,269,877 B1
(45) Date of Patent: Aug. 7, 2001

(54) MAGNETIC ASSEMBLY FOR USE WITH A DOWNHOLE CASING PERFORATOR

(76) Inventors: Ian B. Zeer, R.R. #1, Site #1, Box 2, High River, Alberta (CA), T1V 1N1; Dennis V. Borgstrom, R.R. #6, Site #12, Box 38, LCD9, Calgary (CA), T2M 4L5

( * ) Notice: Subject to any disclaimer, the term of this patent is extended or adjusted under 35 U.S.C. 154(b) by 0 days.

(21) Appl. No.: 09/478,193

(22) Filed: Jan. 5, 2000

(30) Foreign Application Priority Data

Jan. 21, 1999 (CA) ..... 2259776

(51) Int. Cl.[7] ..... E21B 37/00
(52) U.S. Cl. ..... 166/66.5; 166/311; 166/99
(58) Field of Search ..... 166/66.5, 99, 171, 166/173, 311

(56) References Cited

U.S. PATENT DOCUMENTS

| | | | | |
|---|---|---|---|---|
| 2,830,663 | | 10/1958 | Kirby, II . | |
| 2,857,970 | | 10/1958 | Hopkins . | |
| 3,637,033 | | 1/1972 | Mayall . | |
| 4,515,212 | * | 5/1985 | Krugh | 166/99 |
| 4,768,597 | * | 9/1988 | Lavigne et al. | 175/451 |
| 5,327,974 | | 7/1994 | Donovan et al. . | |
| 5,960,894 | * | 10/1999 | Lilly et al. | 175/4.6 |
| 6,170,577 | * | 1/2001 | Noles, Jr. et al. | 166/312 |

FOREIGN PATENT DOCUMENTS 2232941 2/1998 (CA) .

* cited by examiner

*Primary Examiner*—Frank S. Tsay
(74) *Attorney, Agent, or Firm*—Sughrue, Mion, Zinn, Macpeak & Seas, PLLC

(57) ABSTRACT

A magnetic assembly is used in wells that are lined with a metal casing so as to attract and collect resulting metal debris after perforation of the metal casing by a perforating tool. When the perforating tool was activated in the past, the metal debris typically fell downward inside of the metal casing and needed to be retrieved by a flushing or similar procedure. The present invention involves attaching a magnetic assembly to the bottom end of the perforator tool to collect the metal debris as it falls after perforation of the metal casing. The magnetic assembly includes a steel pipe filled with spaced magnetic discs, and also includes a guide shoe on one end of the pipe and a thread adaptor on the other end. The guide shoe facilitates insertion of the magnetic assembly into the mouth of the well casing, and centres the assembly once inside. The thread adaptor is used to attach the magnetic assembly to the bottom end of the perforator tool.

11 Claims, 2 Drawing Sheets

MAGNETIC ASSEMBLY FOR USE WITH A DOWNHOLE CASING PERFORATOR

FIELD OF THE INVENTION

The present invention relates to a magnetic assembly for downhole use in wells lined with a metal casing, and more particularly to a magnetic assembly for use in collecting metal fragments created by perforation of the metal casing.

BACKGROUND OF THE INVENTION

The use of magnets for fishing out "junk", i.e. met al fragments, from wells is well-known. For example, U.S. Pat. No. 3,520,359 (Ehrlich) discloses a magnetic tool consisting of a non-magnetic cage which houses a plurality of permanent magnets. A passage is provided in the tool to allow circulation of fluid downwardly through the tool to wash away non-magnetic materials and thus facilitate the retrieval of metal junk by the magnet. A disadvantage of this type of device, however, is that the tool is suited for use in the retrieval of junk after it has fallen down the well rather than capturing the junk while falling.

Another type of device, exemplified in the disclosure of Canadian Patent Application No. 2,232,941 (Owens et al.), is a magnetic retrieval tool for use in a method wherein a section is cut from a metal casing and a plurality of initially-shielded magnets are then used to retrieve the section. The magnets can either be unshielded by a ink mechanism, or pivotally-mounted magnets can be moved toward the cutout section. This type of device, however, requires ongoing user involvement for its operation, and employs a more complicated mechanism than the subject invention.

SUMMARY OF THE INVENTION

Accordingly, an object of the invention is to facilitate removal of metal junk from a well in a single operation, without the necessity of having to retrieve the perforator tool and then retool for a subsequent junk removal procedure. Another object is to provide a junk removal device which is reliable, requires relatively little maintenance, and is easy to operate.

The invention in one form is a magnetic assembly for use below a perforator tool in a well lined with a metal casing, and including a generally cylindrical magnetic body having a centering means on its distal end and having an attachment means on its proximal end. The centering means on the distal end of the magnetic body maintains the distal end generally centred within the metal casing. The attachment means on the proximal end of the magnetic body supports the magnetic body in use below the perforator tool. The centering means and the attachment means maintain the magnetic body in a generally centred position within the metal casing while allowing fluid to flow past the magnetic body in a generally annular passage created between the metal casing and the magnetic body. After the perforator tool has perforated the metal casing at a location within a resource cavity, the magnetic body collects metal fragments that are carried past it in a resulting fluid flow.

The attachment means may be connected to a central position on a bottom end of the perforator tool in use, such connection providing both support for the magnetic body and centering of the proximal end of the magnetic body. The connection between the attachment means and the perforator tool may be by means of a female threaded portion of the perforator tool engaging with a male threaded portion of the attachment means.

The magnetic assembly may include a tube and at least one magnet positioned within the tube. Preferably, the at least one magnet consists of a plurality of magnets in longitudinally-spaced relation within the tube. The magnetic assembly also includes a plurality of spacers, each extending between a respective adjacent pair of the magnets.

The centering means may include a central body having a rounded tapering nose, and at least three vanes extending generally radially and at equiangular spacing around the central body at a position behind the nose. Each vane extends parallel to the axis of the metal casing, and has an arcuate profile. Preferably, the centering means has four vanes. The centering means may be separable from the magnetic body, and be connected to the magnetic body by means of a female threaded portion of the centering means engaging with a male threaded portion of the magnetic body.

In a more particular form, the invention is a magnetic assembly that includes a pipe section having a threaded distal end and a threaded proximal end, a guide shoe having a first end threadedly mounted on the distal end of the pipe section, and a thread adaptor having a first end threadedly mounted on the proximal end of the pipe section. The pipe section has a series of magnets mounted therewithin in longitudinally-spaced relation. The guide shoe has a rounded tapering nose on a second end and has a central body and a series of equiangularly-spaced vanes extending from the central body. The vanes are sized such that an outer radial extremity of each vane is in use in close proximity to an inside face of the metal casing, and a flow passage extends between adjacent pairs of the vanes. The thread adaptor has a second end adapted to connect to a central position on a bottom face of the perforator tool in use. The pipe section is thereby maintained generally centred within the metal casing such that a generally annular flow passage is created between the pipe section and the metal casing. After the perforator tool has perforated a portion of the metal casing extending through a resource cavity, fragments of the metal casing carried through the annular flow passage by fluid flow resulting from the perforation are magnetically pulled toward, and held on, an outside surface of the pipe section.

BRIEF DESCRIPTION OF THE DRAWINGS

The invention will next be more fully described by means of a preferred embodiment utilizing the accompanying drawing s, in which.

DESCRIPTION OF THE PREFERRED EMBODIMENTS

Figure 1:
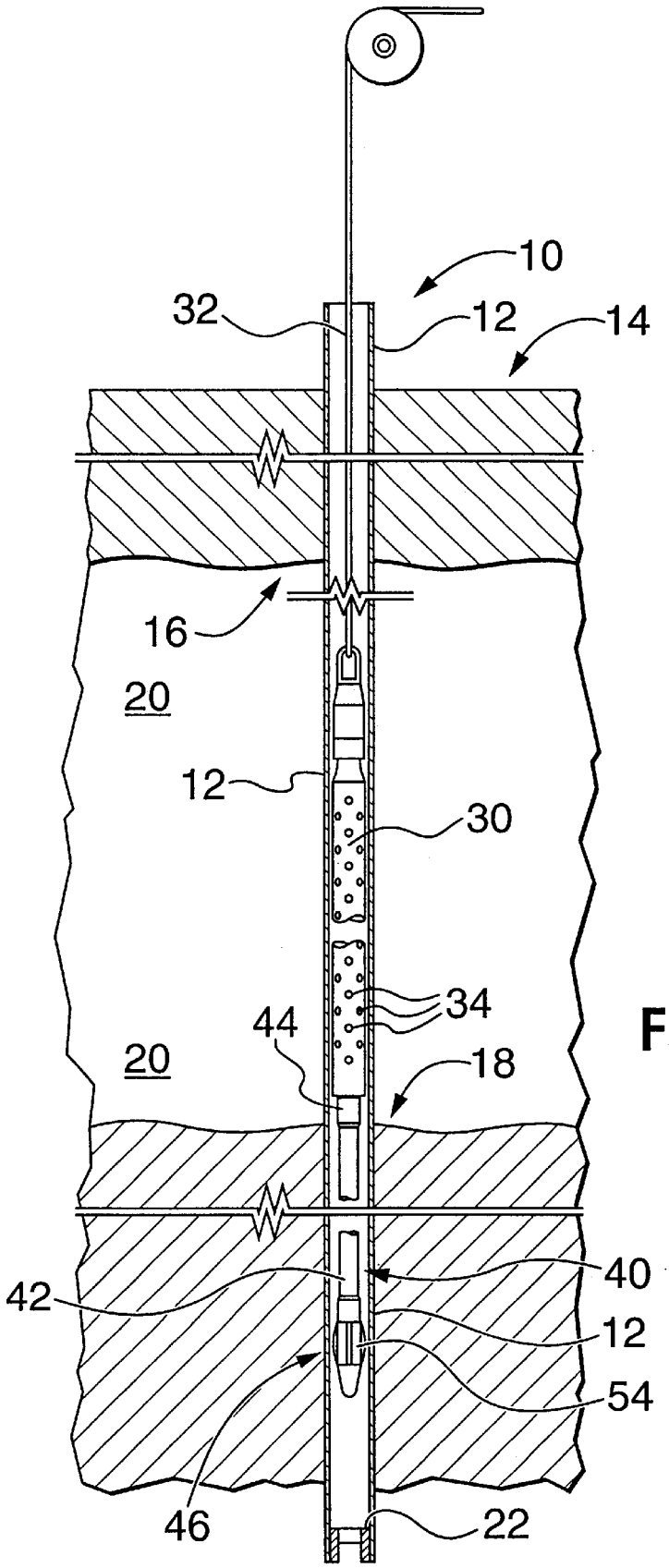
FIG. 1 is a side view of a well with a perforator tool and connected magnetic assembly suspended therein.

As shown in FIG. 1, a well generally designated 10, for gas and/or oil production, includes a steel casing 12 protruding slightly above the ground surface 14 but predominantly extending below the surface. The steel casing 12, which is formed from a series of connected lengths of steel pipe, extends through the roof 16 and into the base 18 of a gas and/or oil cavity 20. The casing 12 has a wire-retrieval plug 22 on its bottom end, the plug preventing the gas and/or oil in cavity 20 from passing th rough casing 12 during drilling.

Once the casing 12 has been extended through the cavity 20, it is necessary to "perforate" the casing 12 to allow the gas and/or oil to escape to the surface for collection; for this purpose a perforating gun 30 is used. The perforating gun 30 is lowered to an elevation within casing 12 that corresponds to where the cavity 20 sits on the other side of casing 12. The perforating gun 30, which is held on the end of a cable 32 suspended from the head of the well 10, is a heavy solid-steel cylinder having a diameter only slightly less than the inside diameter of the casing 12 and a length anywhere from three feet to twenty feet or more. A series of radial holes 34 of uniform diameter (normally between ⅛-inch and ⅝-inch) are positioned symmetrically around the circumference of gun 30. Before perforating gun 30 is inserted into casing 12, an explosive charge is placed into each radial hole 34. Each of the explosive charges is connected to an electrical lead which extends to the surface to an electrical detonator. Each explosive charge has sufficient power to blast a res-pective hole in the metal of the adjacent casing 12. The casing 12 is formed from connected lengths of steel pipe which is either ¼-inch thick or ⅜-inch thick.

The preferred embodiment of the magnetic assembly, generally designated 40, is formed from a length of stainless steel pipe 42. Stainless steel is resistant to corrosive gases, such as $H_2S$ (hydrogen sulphide), which are found in underground pockets of gas and/or oil. A stainless steel adaptor 44 on one end of pipe 42 connects pipe 42 to perforating gun 30. A thread on adaptor 44 allows the adaptor to be connected not only to the perforating gun 30 but also to other equipment or to a wireline cable. The adaptor 44 also serves to isolate any device connected to pipe 42 from the magnetic field around pipe 42. A stainless steel guide shoe 46 on the other end of pipe 42 guides entry of magnetic assembly 40 into the casing 12 at the head of well 10, and also acts to maintain the pipe 42 centred within the casing 12. One end of the adaptor 44 is a male threaded end, and it engages a corresponding female threaded hole in the bottom end of perforating gun 30. The other end of the adaptor 44 is a female threaded end, and it engages a corresponding male threaded end 48 at the top end of pipe 42.

Figure 2:
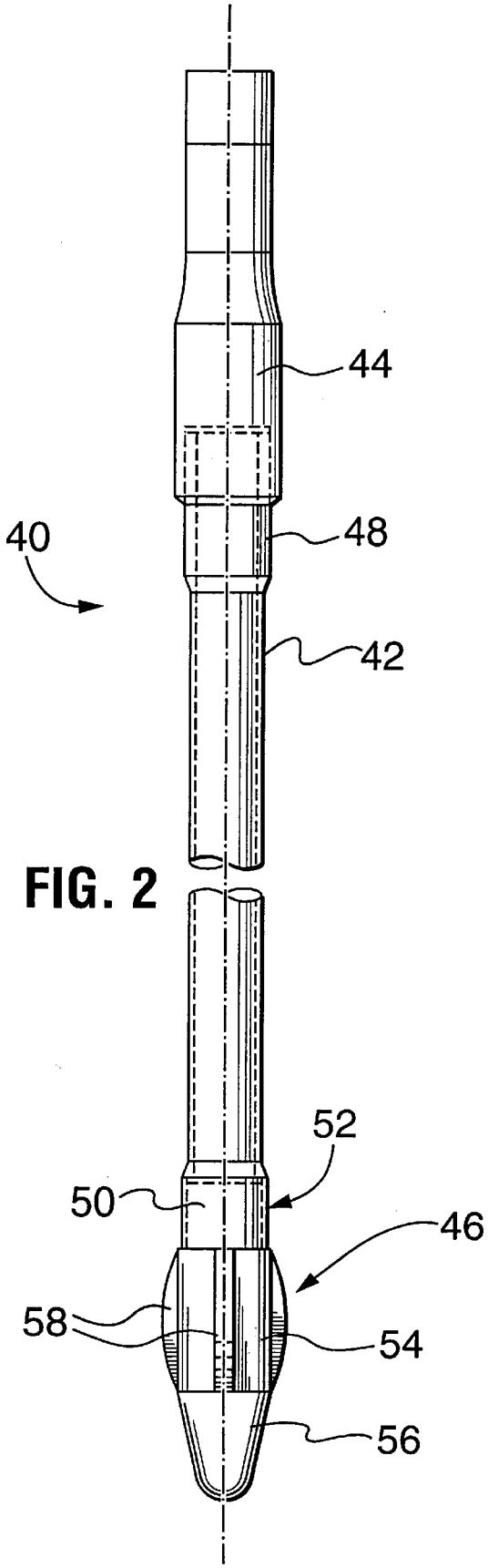
FIG. 2 is a side view of the magnetic assembly.

The magnetic assembly 40 is shown in enlarged view in FIG. 2. The guide shoe 46 has a male threaded end 50 that engages a corresponding female threaded end 52 at the bottom end of pipe 42. The guide shoe 46 also has a central body section 54 and a rounded tapering nose section 56. Spaced at 90°-intervals around central body section 54 are four arcuate stainless steel vanes 58. The distance between the highest points on a diametrically-opposite pair of the vanes 58 is slightly less than the inside diameter of casing 12. When the perforating gun 30 with attached magnetic assembly 40 is being lowered toward the top end of casing 12, the nose section 56 and the vanes 58 ensure that the magnetic assembly 40 is guided centrally within the casing 12. The pipe 42 may have a length in the general range of three to twelve feet, the length depending on factors such as the oil or gas flow rate.

Figure 3:
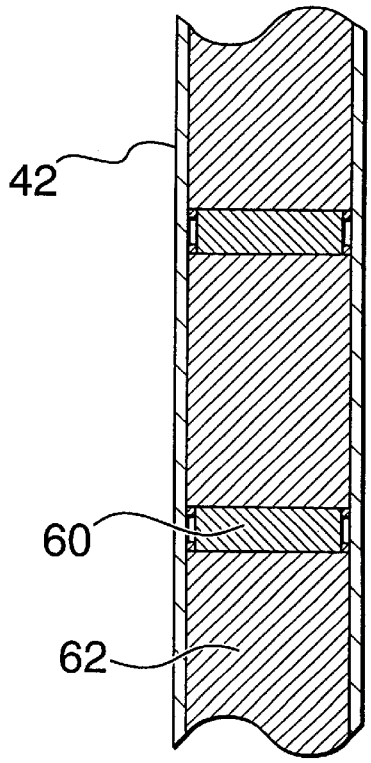
FIG. 3 is a section al side view of the generally cylindrical magnetic body of the magnetic assembly.

FIG. 3 illustrates in cross-section the pipe 42 and its contents, which together form the cylindrical magnetic body of the magnetic assembly 40. A series of cobalt ceramic neo-dinium magnetic circular discs 60 are held in spaced relation from each other within pipe 42 by a series of mild-steel or aluminum circular-cylindrical spacers 62 each of which is epoxy-glued to the inside surface of pipe 42. The metal spacers act to distribute the magnetic field over the length of pipe 42. Each end of pipe 42 is sealed by a stainless steel plug, which not only acts to contain the magnetic field longitudinally but also acts to enhance the side magnetic fields on pipe 42.

The use of the magnetic assembly 40 proceeds as follows. Firstly, while the perforator gun 30 and the magnetic assembly 40 are both resting on ground surface 14, the adaptor 44 on the one end of magnetic assembly 40 is rotated into a complementary threaded opening in the one end of perforator gun 30. The perforator gun 30 and magnetic assembly 40 then form a single elongated assembly 70. Each radial hole 34 in perforator gun 30 is then loaded with an explosive charge. The cable 32 is then used to hoist the elongated assembly 70 into the air above the mouth of casing 12. Casing 12 at this time passes through the cavity 20, and extends into the floor 18 of cavity 20 for a length of at least 50 feet. The nose section 56 and vanes 58 of guide shoe 46 are used to center the elongated assembly 70 as it enters the mouth of casing 12 when cable 32 is released. The elongated assembly 70 is then lowered through casing 12 until the perforator gun 30 is adjacent the bottom portion of cavity 20 (the position shown in FIG. 1). As the elongated assembly 70 is lowered, a series of electrical leads for the explosive charges in the radial holes 34 is fed out; once the perforator gun 30 is in position, the electrical leads are connected to a detonator on the surface.

All of the explosive charges are then detonated at the same time, causing a series of holes to be created in the adjacent positions of the casing 12. It has been found that the elongated assembly 70 is momentarily pushed upward about twenty feet by the explosive force. As a result of that force, metal fragments from the casing 12 are blown into cavity 20. However, high pressure of the gas and/or oil within cavity 20 acts to push many metal fragments from the explosions back toward perforator gun 30. Those metal fragments then normally move with the gas and/or oil flow down the inside of casing 12 and along the annular region surrounding pipe 42 of magnetic assembly 40. As the gas and/or oil moves through that annular region, the magnetic circular discs 60 inside pipe 42 attract the metal fragments—which are retained magnetically on the cylindrical surface of pipe 42. It has been found that, if the pipe 42 is made approximately twenty feet long, it is capable of attracting virtually all of the metal fragments moving past it in the gas and/or oil flow.

Once the initial downward flow of the gas and/or oil past the magnetic assembly 40 has ceased, i.e. flow is only upward through the casing 12, the elongated assembly 70 can be hoisted to the surface with the captured metal fragments adhering to pipe 42. As a result, it usually becomes unnecessary after perforation to use a tubing unit to pump fluid down the hole to flush material out of the hole—an operation that costs both time and money before the plug 22 can be removed with a wireline. Flushing a hole can cause damage to ground formations, and can force fragments out through perforations. Those fragments may then return with production flow, causing damage downhole and/or above ground to meters, valves and other equipment.

The magnetic assembly of the subject invention can be utilized with conventional or service rigs, and can be utilized with any type of tool string. Various sizes of the assembly may be used for holes of various sizes, and it may be utilized with horizontal as well as vertical drill holes.

We claim:

1. A magnetic assembly for use below a perforator tool in a well lined with a metal casing, comprising:

a generally cylindrical magnetic body having a distal end and a proximal end;

a centering means on the distal end of the magnetic body for maintaining the distal end generally centred within the metal casing; and, an attachment means on the proximal end of the magnetic body for supporting the magnetic body in use below the perforator tool;

wherein the centering means and the attachment means maintain the magnetic body in a generally centred position within the metal casing while allowing fluid to flow past the magnetic body in a generally annular passage created between the metal casing and the magnetic body, and wherein, after the perforator tool has perforated the metal casing at a location within a resource cavity, the magnetic body collects metal fragments carried past the magnetic body in a resulting fluid flow.

2. A magnetic assembly as in claim 1, wherein the attachment means is connected to a central position on a bottom end of the perforator tool in use, such connection providing both support for the magnetic body and centering of the proximal end of the magnetic body.

3. A magnetic assembly as in claim 2, wherein the connection between the attachment means and the perforator tool is by means of a female threaded portion of the perforator tool engaging with a male threaded portion of the attachment means.

4. A magnetic assembly as in claim 1, wherein the assembly comprises:

a tube; and, at least one magnet positioned within the tube.

5. A magnetic assembly as in claim 4, wherein the at least one magnet consists of a plurality of magnets in longitudinally-spaced relation.

6. A magnetic assembly as in claim 1, wherein the assembly comprises:

a tube;

a plurality of magnets positioned within the tube in longitudinally-spaced relation; and, a plurality of spacers, each extending between a respective adjacent pair of the magnets.

7. A magnetic assembly as in claim 1, wherein the centering means comprises:

a central body having a rounded tapering nose; and, at least three vanes extending generally radially and at equiangular spacing around the central body at a position behind the nose, each vane extending parallel to the axis of the metal casing and having an arcuate profile.

8. A magnetic assembly as in claim 7, wherein the centering means has four vanes.

9. A magnetic assembly as in claim 1, wherein the centering means is separable from the magnetic body and is connected to the magnetic body by means of a female threaded portion of the centering means engaging with a male threaded portion of the magnetic body.

10. A magnetic assembly as in claim 9, wherein the centering means is separable from the magnetic body and is connected to the magnetic body by means of a female threaded portion of the central body of the centering means engaging with a male threaded portion of the magnetic body.

11. A magnetic assembly for use below a perforator tool in a well lined with a metal casing, comprising:

a pipe section having a series of magnets mounted therewithin in longitudinally-spaced relation, the pipe section having a threaded distal end and a threaded proximal end;

a guide shoe having a first end threadedly mounted on the distal end of the pipe section, the guide shoe having a rounded tapering nose on a second end and having a central body and a series of equiangularly-spaced vanes extending from the central body, the vanes being sized such that an outer radial extremity of each vane is in use in close proximity to an inside face of the metal casing and a flow passage extends between adjacent pairs of the vanes; and, a thread adaptor having a first end threadedly mounted on the proximal end of the pipe section, the thread adaptor having a second end adapted to connect to a central position on a bottom face of the perforator tool in use; wherein the pipe section is thereby maintained in a generally centred position within the metal casing such that a generally annular flow passage is created between the pipe section and the metal casing, and wherein, after the perforator tool has perforated the metal casing at a location within a resource cavity, fragments of metal carried through the annular flow passage by resulting fluid flow are magnetically pulled toward, and held on, an outside surface of the pipe section.

* * * * *